US011149704B2

(12) United States Patent
Walsh et al.

(10) Patent No.: US 11,149,704 B2
(45) Date of Patent: Oct. 19, 2021

(54) METHOD OF TESTING FUEL INJECTION EQUIPMENT

(71) Applicant: DELPHI TECHNOLOGIES IP LIMITED, St. Michael (BB)

(72) Inventors: Aaron Walsh, Northampton (GB); Lee Raymond Jacobs, Leamington (GB)

(73) Assignee: DELPHI TECHNOLOGIES IP LIMITED

( * ) Notice: Subject to any disclaimer, the term of this patent is extended or adjusted under 35 U.S.C. 154(b) by 394 days.

(21) Appl. No.: 16/303,559

(22) PCT Filed: May 22, 2017

(86) PCT No.: PCT/EP2017/062309

§ 371 (c)(1),
(2) Date: Nov. 20, 2018

(87) PCT Pub. No.: WO2017/202790

PCT Pub. Date: Nov. 30, 2017

(65) Prior Publication Data

US 2020/0309078 A1 Oct. 1, 2020

(30) Foreign Application Priority Data

May 24, 2016 (GB) ..... 1609114

(51) Int. Cl.

| | |
|---|---|
| ***F02M 65/00*** | (2006.01) |
| ***F02D 41/22*** | (2006.01) |
| ***F02D 41/30*** | (2006.01) |
| ***F02D 41/38*** | (2006.01) |
| ***F02M 55/02*** | (2006.01) |

(52) U.S. Cl.
CPC ..... *F02M 65/001* (2013.01); *F02D 41/22* (2013.01); *F02D 41/3082* (2013.01); *F02D 41/3845* (2013.01); *F02M 55/025* (2013.01); *F02D 2041/224* (2013.01)

(58) Field of Classification Search
CPC ..... F02M 65/00–002; F02M 59/205; F02M 59/466; F02D 41/22; F02D 41/221; F02D 41/3082; F02D 41/38–3863; F02D 41/406; F02D 2041/224; F02D 2041/226
USPC ..... 73/114.41, 114.45; 123/446, 447, 457, 123/458, 497, 198 D; 701/103, 104
See application file for complete search history.

(56) References Cited

U.S. PATENT DOCUMENTS 5,845,225 A 12/1998 Mosher
2006/0243244 A1* 11/2006 Kasbauer ..... F02D 41/3809 123/333

(Continued)

FOREIGN PATENT DOCUMENTS

CN 101968018 A 2/2011
CN 201802535 U 4/2011

(Continued)

*Primary Examiner* — Logan M Kraft
*Assistant Examiner* — Robert A Werner
(74) *Attorney, Agent, or Firm* — Joshua M. Haines

(57) ABSTRACT

A method of testing a fuel injection system or components thereof includes running a high pressure fuel pump to provide fluid under pressure to the fuel injection system or components. The pump flow is controlled via an inlet metering valve by controlling current or voltage supplied to the inlet metering valve dependent on the power to the fuel pump.

11 Claims, 4 Drawing Sheets

(56) References Cited

U.S. PATENT DOCUMENTS

| | | | | |
|---|---|---|---|---|
| 2007/0051340 | A1 | 3/2007 | Tsujimoto | |
| 2007/0243077 | A1 | 10/2007 | Haerer | |
| 2011/0125387 | A1 | 5/2011 | Suzuki et al. | |
| 2012/0239272 | A1 | 9/2012 | Hackner et al. | |
| 2013/0013175 | A1* | 1/2013 | Nistler | F02D 41/22 701/112 |
| 2015/0020777 | A1 | 1/2015 | Carey et al. | |
| 2018/0142642 | A1* | 5/2018 | Grime | F02D 41/3082 |
| 2019/0063359 | A1* | 2/2019 | Kuempel | F02D 41/2464 |

FOREIGN PATENT DOCUMENTS

| | | | |
|---|---|---|---|
| CN | 202381234 | U | 8/2012 |
| JP | 2008231919 | A | 10/2008 |

* cited by examiner

METHOD OF TESTING FUEL INJECTION EQUIPMENT

CROSS REFERENCE TO RELATED APPLICATIONS

This application is a national stage application under 35 USC 371 of PCT Application No. PCT/EP2017/062309 having an international filing date of May 22, 2017, which is designated in the United States and which claimed the benefit of GB Patent Application No. 1609114.2 filed on May 24, 2016, the entire disclosures of each are hereby incorporated by reference in their entirety.

FIELD OF THE INVENTION

This disclosure relates to fuel injection test equipment and in particular to fuel injection test equipment/systems including a electrically controlled or driven high pressure pump adapted to provide high pressure fuel to fuel injectors (e.g. via a common rail), or other component under test where the flow control rate is controlled by an Inlet Metering Valve.

BACKGROUND OF THE INVENTION

Test equipment used to test (e.g. faulty) fuel injectors can comprise an electrically operated and controlled high pressure pump to supply (e.g. via a common rail) fuel injectors under test. Flow from the pump to the injectors common rail is controlled by an Inlet Metering Valve IMV which are typically controlled electrically, e.g. by passing current through e.g. a valve solenoid. There may also be control of pressure via a pressure control valve (PCV) located downstream of or integral with the pump e.g. on the common rail.

In testing the fuel flow/volume into a Common Rail pump is normally regulated by an electrical proportional valve known as an Inlet Metering Valve (IMV) sometimes referred to as a Volume Control Valve (VCV). The flow/volume is normally proportional to the electrical drive current into the valve.

The fuel pressure on a Common Rail pump outlet is normally regulated by an electrical proportional valve known as a Pressure Control Valve (PCV). The pressure is normally proportional to the electrical drive current into the PCV. The valve can be internal or external to the pump. Normally, when testing Fuel Injection Equipment like common rail systems, a controller uses a pressure feedback signal in a 'closed loop' to determine the PCV drive current to be applied.

Normally, when testing equipment, a (e.g. common rail) system controller uses a 'map' or look up table to determine the IMV drive current. However, this relies on theoretical information about the Common Rail components such as IMV, PCV, pump and injectors and their operating states. Manufacturing tolerances, wear are not taken into account.

On a diesel fuel injection test bench the IMV drive requirements are further complicated by the following various other factors, typically as a result of testing faulty fuel injectors or systems where faulty injectors may be e.g. blocked and the pressure ranges required to satisfactorily test them are wide. The flow characteristics of the injectors under test may be unknown. Injectors may misfire or not fire at all. Test sequences may require single or multiple injector firing The power required to drive the Common Rail pump is proportional to the sum of the fuel flow and fuel pressure.

Too much flow and the power required to drive the Common Rail pump will be too high. Too little flow and the injectors will be starved of fuel.

In known techniques when controlling IMVs (e.g. the IMV current), depending on pressure test ranges, IMV current is set at a particular level. This is far from ideal and also a nominal pressure range may not be adequate to provide testing over the required pressure range. Thus prior art techniques use a IMV map/lookup table, e.g. dependent on the pressure requirement, which may be unknown.

It is an object of the invention to overcome these problems; problems of unknown injector characteristics, too much IMV flow, too little IMV flow, excess power to drive the common rail pump, manufacturing tolerances and components wear are solved by adjusting the IMV drive current to achieve the desired/optimum Common Rail pump drive power.

STATEMENT OF THE INVENTION

In one aspect is provided a method of testing a fuel injection system or components thereof, the testing being implemented by running a high pressure fuel pump to provide fluid under pressure to said fuel injection system or components, where the pump flow is controlled via an Inlet Metering Valve associated therewith, including the step of:

a) controlling the IMV current or voltage, dependent on the power to the fuel pump.

Said fuel pump may be driven by an electrical motor and the power is determined from the voltage and/or across the electrical motor.

The IMV current or voltage may be controlled solely to be dependent on said power.

Said fuel injection component may be one or more fuel injectors.

Said fuel injector may be supplied via a common rail fluidly located between said pump and said fuel injector(s).

Said common rail may include a pressure control valve.

The power of said pump is preferably kept above a minimum threshold level or below a maximum threshold level.

Controlling the IMV current or voltage may comprises incrementing the current/voltage of the IMV dependent on whether the motor current/voltage or power is below or above a minimum or maximum threshold respectively.

The increment applied in may be variable and depend on rail pressure.

BRIEF DESCRIPTION OF DRAWINGS

The invention will now be described by way of example and with reference to the following figure of which.

DESCRIPTION OF THE INVENTION

Figure 1:
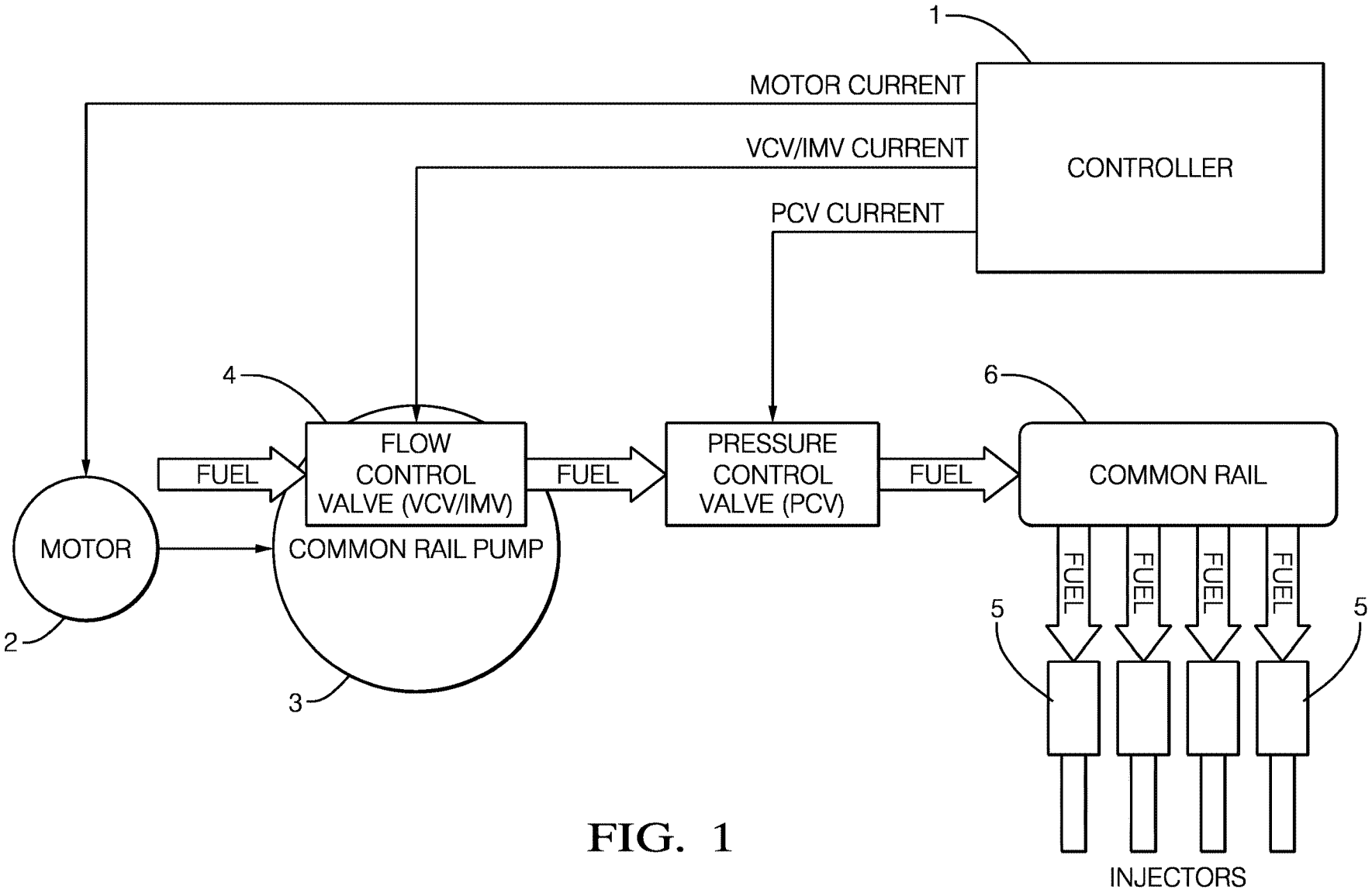
FIG. 1 shows apparatus used to test a fuel injection system or components thereof.

FIG. 1 shows apparatus or system used to test a fuel injection system or components thereof. The system is controlled by a controller 1. The controller may comprise an ECU connected to an auxiliary processor or circuitry.

A motor 2 which may be an electrically or electronically controlled/operated motor is used to power a high pressure (e.g. fuel) pump 3. This may be part of or separate to the fuel injection system or components under test. The pump flow is controlled by an Inlet Metering Valve (IMV) 4 associated therewith. The IMV may be integral with the pump. Flow of fuel may be to fuel injection component under test such as one or more fuel injectors 5. The fuel injectors may be provided with flow from the pump via a common rail 6. The common rail may include a pressure control valve (PCV) and/or pressure sensor 7.

In one aspect the IMV is controlled based on the power supplied to the high pressure e.g. common rail pump. The IMV can be controlled by varying the current through it. Thus IMV current is made a function of pump power.

The power to the pump may be determined by measuring or otherwise determining the voltage and/or current across the motor used to drive the pump.

In a preferred aspect the IMV is controlled solely based on the pump power. Thus in one aspect there may be drive power monitoring means and the drive power optimizes the IMV drive current accordingly.

Preferably the motor power is also controlled or limited to a particular power band, i.e. the test equipment system/method can ensure that the power to the pump is not above or below a maximum or minimum level depending on application. This prevents either too high pressure/power, and also prevents to little pressure/power such that there may not be sufficient flow/pressure to test (e.g. faulty) injectors. It is to be understood that the skilled person could readily ascertain power bands parameters.

EXAMPLE

Figure 2A:
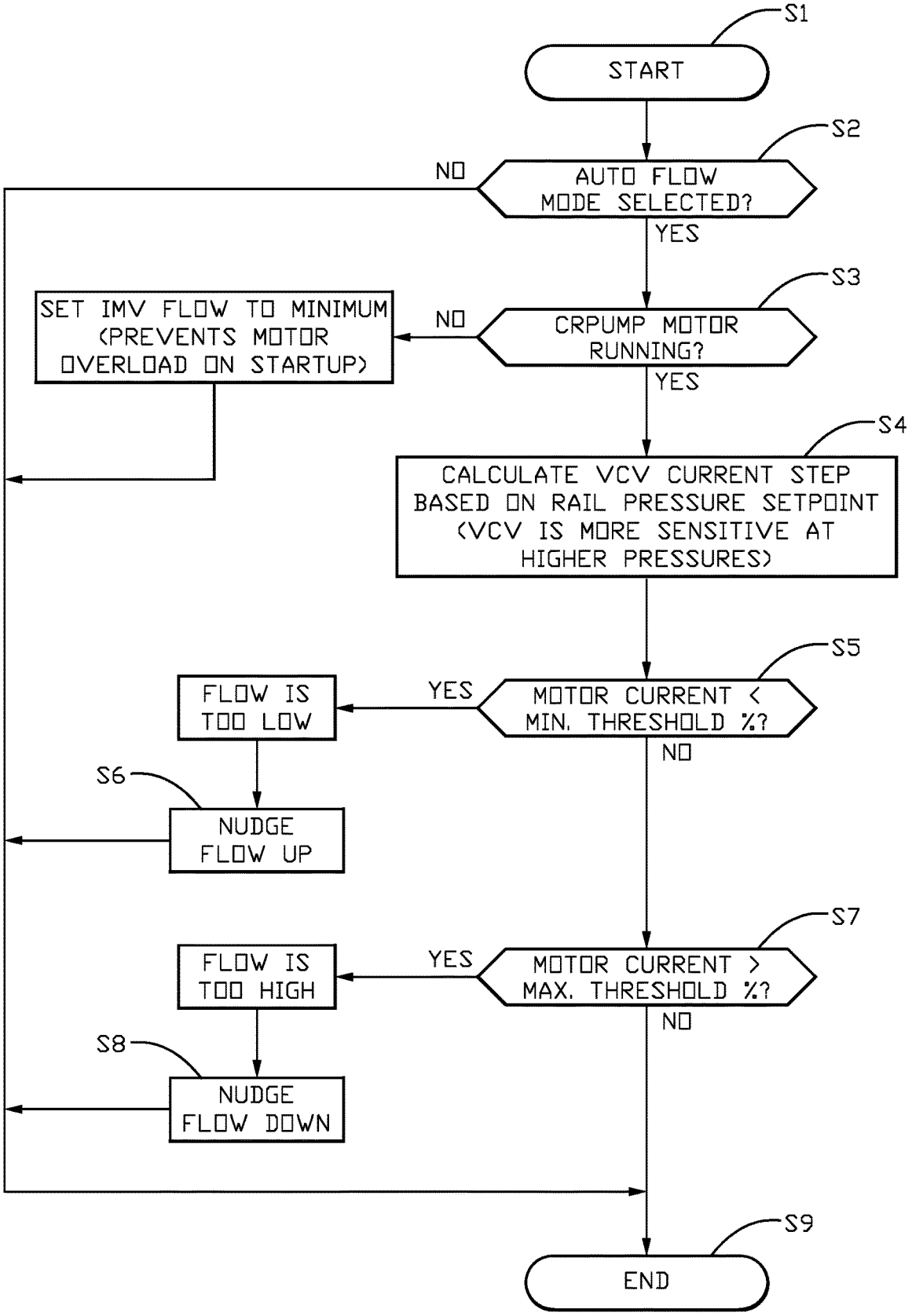
FIGS. 2*a, b, c* shows flow charts of one example of implementation of the invention.

FIG. 2 shows flow charts of one example of implementation of the invention. FIG. 2*a* is the main flow chart. The process starts with step S1. At step S2 it is decided whether "auto-flow" mode is selected. If so the process proceed to step S3 where it is determined if the common rail pump motor is running. If so the process proceeds to step S4. In this optional step the VCV current step (increment) which may be applied in later steps is determined based on the rail pressure set-point/actual rail pressure. If the rail pressure is very high any increment of the IMV current i.e. change to the IMV current made is preferably small, and vice versa.

In steps S5 and S7 it is determined if the motor current (which is equivalent to power for a fixed voltage electric motor) drives the (common rail pump) is within a certain band. In step S5 it is determined if the motor current is less than a particular level i.e. lower threshold of the band. If so the process proceeds to step S6 where the flow is nudged up by varying the current thought the IMV. This may be performed by an incremental change to the current, the incremental change being dependent on the results of step S4. In order to increase flow the current to the IMV may be increased or decreased depending on the IMV design and logic. Positive logic is defined as where the flow is increased by the IMV if the current is increased. Negative logic is the converse. In steps S7 it is determined if the motor current is more than a particular level i.e. higher threshold of the band. If so the flow is nudged down by making an incremental change to the IMV current appropriately. Again this incremental change may be dependent on the results of step S4.

Regarding steps S4, typically in one example, an IMV control range is between 550-750 mA. For other pumps the range may be from 0 to 2 amps. The "nudge" can be an increment (up or down) of say 2-19 mA dependent on the rail pressure (set-point).

The advantages are that the system automatically compensates for unknown injector characteristics, too much IMV flow, too little IMV flow, excess power to drive the Common Rail pump, manufacturing tolerances and components wear. Map/lookup table generation, storage and reading are not required.

Figure 2B:
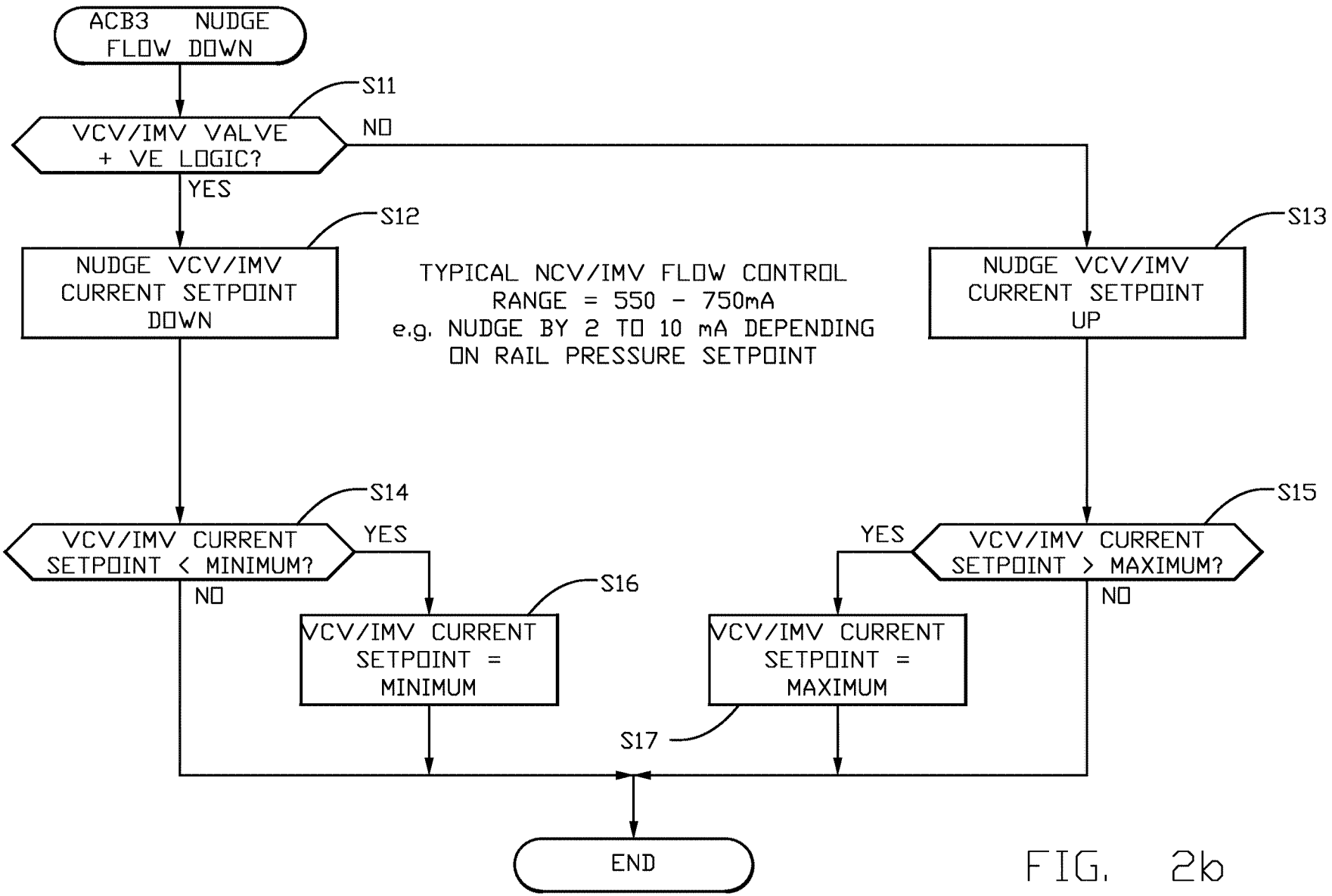

FIGS. 2*b* and *c* show flow charts of how the flow can be nudged down or up separately.

In FIG. 2*b* the process shows the control of how the flow is nudged down. In step S11 it is determined if the IMV valve logic is positive or negative. As mentioned positive is where increase in current provides higher flow. In steps S12 and S13 dependent on the logic the IMV current is incremented up or down. Steps S14 and S15 determine if the IMV current is as a result below or above minimum or maximum set-point respectively. If this is the case the IMV current is set to the minimum or maximum (set-point value) respectively in steps S16 and S17.

Figure 2C:
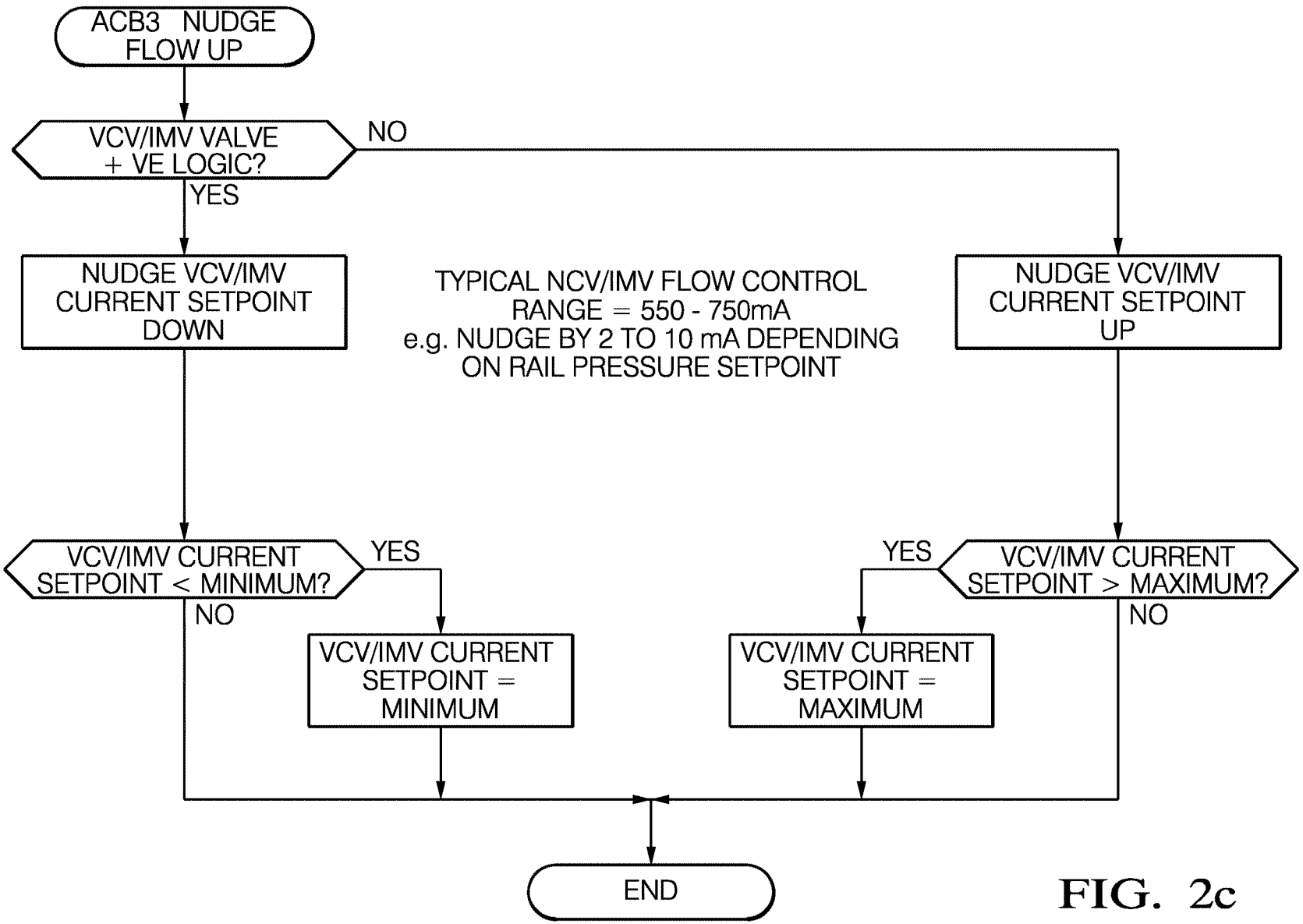

FIG. 2*c* shows the equivalent and corresponding process for nudging the flow up.

The invention claimed is:

1. A method of testing a fuel injection system or components thereof, the method comprising:

running a high pressure fuel pump to provide fluid under pressure to the fuel injection system or the components;

controlling pump flow of the high pressure fuel pump with an inlet metering valve; and controlling current or voltage supplied to the inlet metering valve based on power to the high pressure fuel pump.

2. The method as claimed in claim 1, where the high pressure fuel pump is driven by an electrical motor and the power is determined from the voltage across and/or current through the electrical motor.

3. The method as claimed in claim 1, wherein the current or the voltage is controlled solely to be dependent on the power.

4. The method as claimed in claim 1, wherein the components are one or more fuel injectors.

5. The method as claimed in claim 4, wherein the one or more fuel injectors are supplied via a common rail fluidly located between the high pressure fuel pump and the one or more fuel injectors.

6. The method as claimed in claim 5, wherein the common rail includes a pressure control valve.

7. The method as claimed in claim 1, wherein the power to the high pressure fuel pump is kept above a minimum threshold level or below a maximum threshold level.

8. The method as claimed in claim 1, wherein said controlling current or voltage supplied to the inlet metering valve based on power to the high pressure fuel pump is performed while said high-pressure fuel pump is running.

9. The method as claimed in claim 2, where the high pressure fuel pump is driven by an electrical motor and the power is determined from the voltage across and/or current through the electrical motor while the electric motor is running.

10. A method of testing a fuel injection system or components thereof, the method comprising:

running a high pressure fuel pump to provide fluid under pressure to the fuel injection system or the components;

controlling pump flow of the high pressure fuel pump with an inlet metering valve; and controlling current or voltage supplied to the inlet metering valve based on power to the high pressure fuel pump;

wherein controlling the current or the voltage supplied to the inlet metering valve comprises incrementing the current or the voltage based on whether the current or the voltage or power is below or above a minimum threshold or a maximum threshold respectively.

11. The method as claimed in claim 10 wherein, the incrementing is variable and based on a rail pressure.

* * * * *